US005131661A

United States Patent [19]

Jorgensen

[11] Patent Number: 5,131,661

[45] Date of Patent: Jul. 21, 1992

[54] GOLF SWING PRACTICE APPARATUS WITH AUTOMATIC TEEING DEVICE

[75] Inventor: Morell L. Jorgensen, Honeoye Falls, N.Y.

[73] Assignee: Tee-Matic, Inc., Honeoye, N.Y.

[21] Appl. No.: 712,586

[22] Filed: Jun. 10, 1991

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 2,390,998 | 12/1945 | Gale | 273/201 |
| 2,464,550 | 3/1949 | Bauer | 273/201 |
| 3,756,606 | 9/1973 | Land | 273/201 |
| 3,758,118 | 9/1973 | Willcox | 273/201 |
| 4,441,717 | 4/1984 | Willcox | 273/201 |
| 4,541,632 | 9/1985 | Tilley | 273/201 |
| 4,602,789 | 7/1986 | Chung | 273/201 |

*Primary Examiner*—Theatrice Brown

*Attorney, Agent, or Firm*—Shlesinger, Fitzsimmons & Shlesinger

[57] ABSTRACT

A frame has on its upper end a horizontal platform covered with a synthetic, turf-like material, and disposed to support at least one practice golfer thereon. A motor operates intermittently to supply golf balls from a hopper, which is located at one side of the platform, to a pivotal chute which feeds the balls one-by-one to the upper end of a tee, which is also reciprocated by the motor between a lowered position beneath the platform, at which time a golf ball is automatically positioned on its upper end, and an elevated position in which the tee raises the ball upwardly to a teed position through a delivery hole in a resilient, replaceable hitting surface on the platform. The portion of the platform containing the hitting surface can be pivoted upwardly when it becomes necessary to replace the hitting surface. A collapsible cage can be placed in front of the platform to catch golf balls driven therefrom, and to return the balls to the hopper.

18 Claims, 6 Drawing Sheets

GOLF SWING PRACTICE APPARATUS WITH AUTOMATIC TEEING DEVICE

BACKGROUND OF THE INVENTION

This invention relates to golf swing practice apparatus, which includes a mechanism for automatically teeing golf balls one after the other into an operative position relative to a golfer, and more particularly this invention relates to apparatus of the type described which includes a novel tee pad section, and an optional cage which can be positioned in front of the golfer to collect and return golf balls after they have been hit.

There are currently available on the market a variety of golf swing practice devices which enable a golfer to practice his or her swing, for example out-of-doors on a practice golf range or the like, or even within doors in the event that weather is inclement or less than temperate. Moreover, at least certain of such prior art apparatus include a device for automatically or at least semi-automatically teeing up a golf ball to obviate the need for the golfer to perform this operation manually.

U.S. Pat. No. 1,598,971, for example, discloses a foot-operated plunger, which projects upwardly from the floor on which the golfer stands, and which can be pushed downwardly by his or her foot, and in so doing will automatically cause an associated tee device to drop downwardly to receive a golf ball from a supply thereof. After the golfer removes his or her foot from the plunger, the tee device rises to position the golf ball in readiness to be struck by the golfer's club. U.S. Pat. No. 1,850,174 discloses a generally similar mechanism, but instead of using one's foot to operate the device, the golfer momentarily depresses the tee actuating device with his or her golf club.

A far more sophisticated device is disclosed in U.S. Pat. No. 3,738,663, which is directed to an automatic golf ball teeing apparatus which is operated by a digital control mechanism. This type of mechanism, however, has the disadvantage that the tee elevating and lowering mechanism comprises a rack and pinion connection. The pinion is driven directly by an electric motor, and the rack is connected directly to the tee elevating mechanism, so that the height of the tee is a direct function of the operation of the motor. This makes it extremely difficult to make any adjustment in the height of the tee. Moreover this prior art mechanism permits the selection of only two different operating positions of the ball-supporting tee—i.e., in a first or so-called "fairway shots" position, and a second slightly higher referred to as the "tee shot" position. This can be extremely frustrating for the golfers who would prefer, for example, to have the ball positioned unusually high for a tee shot, or, conversely, particularly low or closer to the ground for a fairway shot.

Accordingly, it is an object of this invention to provide improved golf swing practice apparatus of the type described, which automatically tees up golf balls for practicing golfers, and which also permits each golfer to adjust the height of the ball supporting tee mechanism to suit his or her preferences.

Still another object of this invention is to provide improved apparatus of the type described which is particularly suited for use either out-of-doors in a golf driving range surrounding, or indoors in connection with an associated cage which can be employed to collect and return golf balls that have been driven by a practicing golfer.

It is an object also of this invention to provide for apparatus of the type described a tee pad section which can be readily replaced or repaired after prolonged use.

Another object of this invention is to provide apparatus of the type having a novel, resilient, replaceable tee pad section which provides the practice golfer with the feeling and/or illusion that he or she is hitting from an actual tee or fairway surface.

Other objects of the invention will be apparent hereinafter from the specification and from the recital of the appended claims, particularly when read in conjunction with accompanying drawings.

SUMMARY OF THE INVENTION

A horizontal platform covered with synthetic turf confronts upon the open end of a collapsible cage into which a practice golfer may drive golf balls which are automatically teed up one after the other onto a special hitting area on the platform. Golf balls are fed from a hopper at one side of the platform to one end of a feed chute, which is mounted beneath the platform for pivotal movement with a ball teeing arm between raised and lowered positions by the same operating cam. When the teeing arm pivots upwardly to place a golf ball in a teed position just above the turf in the hitting area of the platform, the feed chute discharge end is also elevated to place the next golf ball on a receiving platform. After the teed ball has been struck the teeing arm and feed chute pivot to lowered positions, during which movement of the discharge end of the feed chute is closed off. When the tee reaches its lowered position, a new golf ball rolls onto the upper end thereof from the receiving platform, and in position to be elevated up to its teed position.

The hitting area of the platform is rectangular in configuration, and is hingedly connected at one end to a stationary portion of the platform to permit the hitting area to be swung upwardly to expose its underside when it is desired to replace the turf-like covering of the hitting area after it has become worn, or when access to the feed chute and pivotal tee arm is desired. Also when the hitting area has been swung upright, the tee itself is accessible and may be replaced if necessary. The apparatus may be controlled by a console mounted on the ball hopper; and the cage can be collapsed or removed when it is not needed.

THE DRAWINGS

DETAILED DESCRIPTION OF THE PREFERRED EMBODIMENTS

Figure 1:
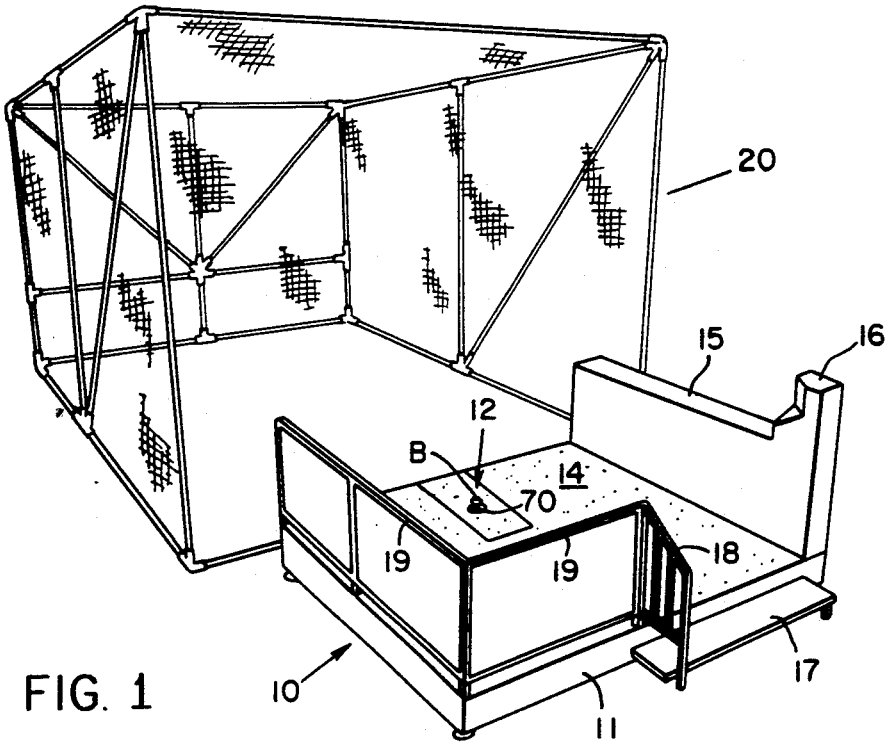
FIG. 1 is a perspective view of golf swing practice apparatus made according to one embodiment of this invention, the apparatus including a platform upon which a practice golfer stands to drive golf balls, and a collapsible cage which is positioned adjacent the platform and into which the golfer drives practice golf balls.

Referring now to the drawings by numerals of reference, and first to FIG. 1, 10 denotes generally a practice platform comprising a generally rectangularly shaped metal frame or base 11 having secured over and closing the upper end thereof, except for a small rectangular hitting area denoted generally by the numeral 12, a plurality of plywood panels 13 or sections thereof, each of which panels or sections is covered by a layer 14 of artificial turf. Secured to and extending along one side of the frame 11, and projecting above its turf surface 14 is an elongate ball hopper 15, which has an electronic control console or pedestal 16 projecting upwardly from one end thereof. An entrance step 17 is secured to the rear of frame 11 adjacent the ball hopper 15 to provide access to the turf covered surface of the platform. A hand railing 18, which is mounted adjacent one end of the steps 17 is connected to a set of railings 19, which extend along the rear of the frame 11 and along the side thereof remote from the hopper 15.

In the embodiment as shown in FIG. 1, the hitting section 12 of the platform 10 confronts upon the open end of a large golf ball collecting cage 20, which is positioned in front of frame 11. As noted hereinafter, the cage 20 is optional, and preferably is used when the platform 10 located within a building. On the other hand, if the platform 10 is utilized out-of-doors, such as for example at a golf driving range or the like, the cage 20 can be eliminated. Also if a number of platforms 10 are mounted side by side, the railing 19 along one side of each frame 11 can be eliminated.

Figure 2:
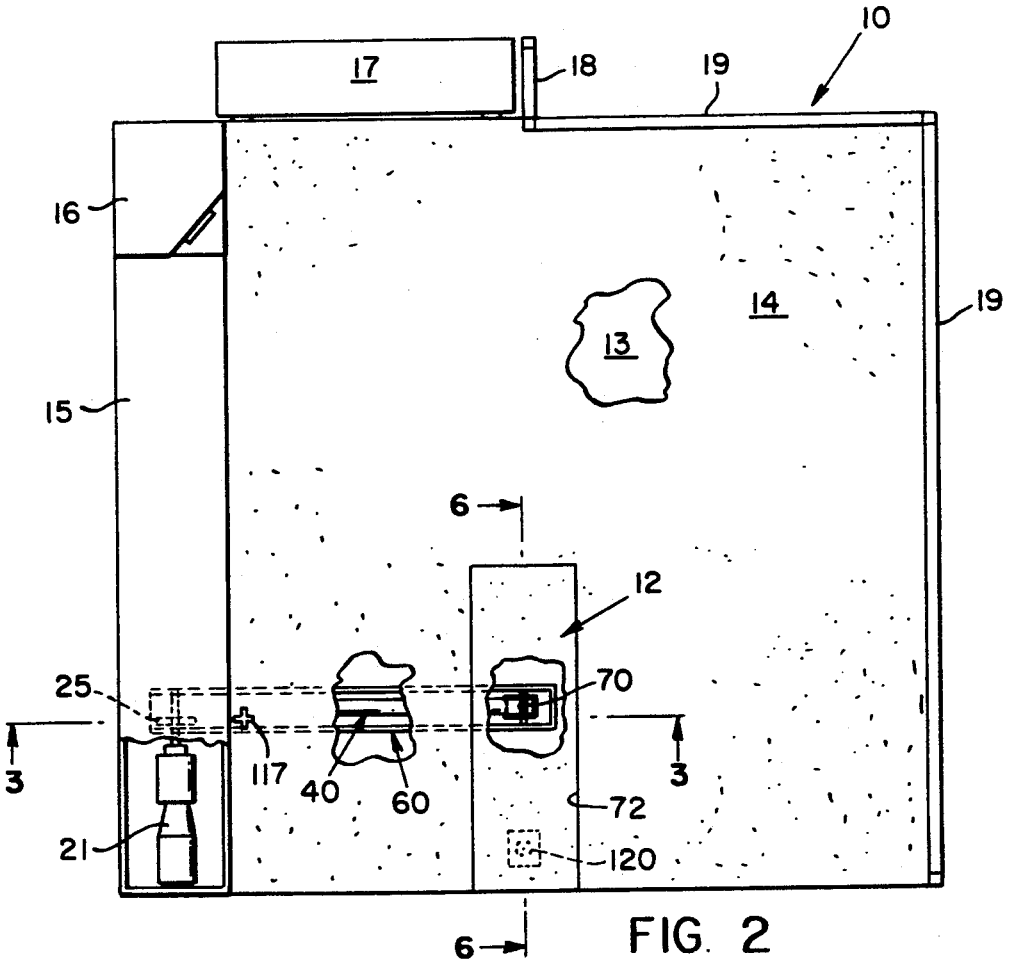
FIG. 2 is a slightly enlarged plan view of the platform section of the apparatus shown in FIG. 1, with portions of the platform being broken away and shown in section.

Referring now to FIGS. 2 to 5, the hopper 15 has mounted in one end thereof (the lower end as shown in FIG. 2) a conventional gear motor 21 having keyed or otherwise secured to its output shaft 23 the hub 24 of an operating cam 25. The outer periphery of cam 25 has rolling engagement with the periphery of a tubular cam follower 26, which is rotatably mounted on an pin or shaft 27, opposite ends of which are secured in the spaced, parallel arms 28 of a cam lever which is denoted generally by the numeral 30. Arms 28 are interconnected at one end thereof (the left ends in FIGS. 3 and 4) by an integral, rigid, transversely extending strap 31, and at their opposite ends are interconnected by a pair of integral, parallel, generally horizontally disposed strap sections 32 and 33, respectively. Section 32 extends transversely between the upper edges of the arms 28, while section 33 interconnects the lower ends of downwardly extending, dog-leg sections 34, which are formed on the ends of arms 28 remote from the strap section 31. The two downwardly extending sections 34 of the arms 28 are keyed or otherwise secured to a pivot shaft 35 having reduced-diameter ends 36 (FIG. 5), which are journaled in a pair of registering, laterally spaced bearing blocks 37 that are fastened to one side of transverse frame member 38 that forms part of the base 11.

Figure 3:
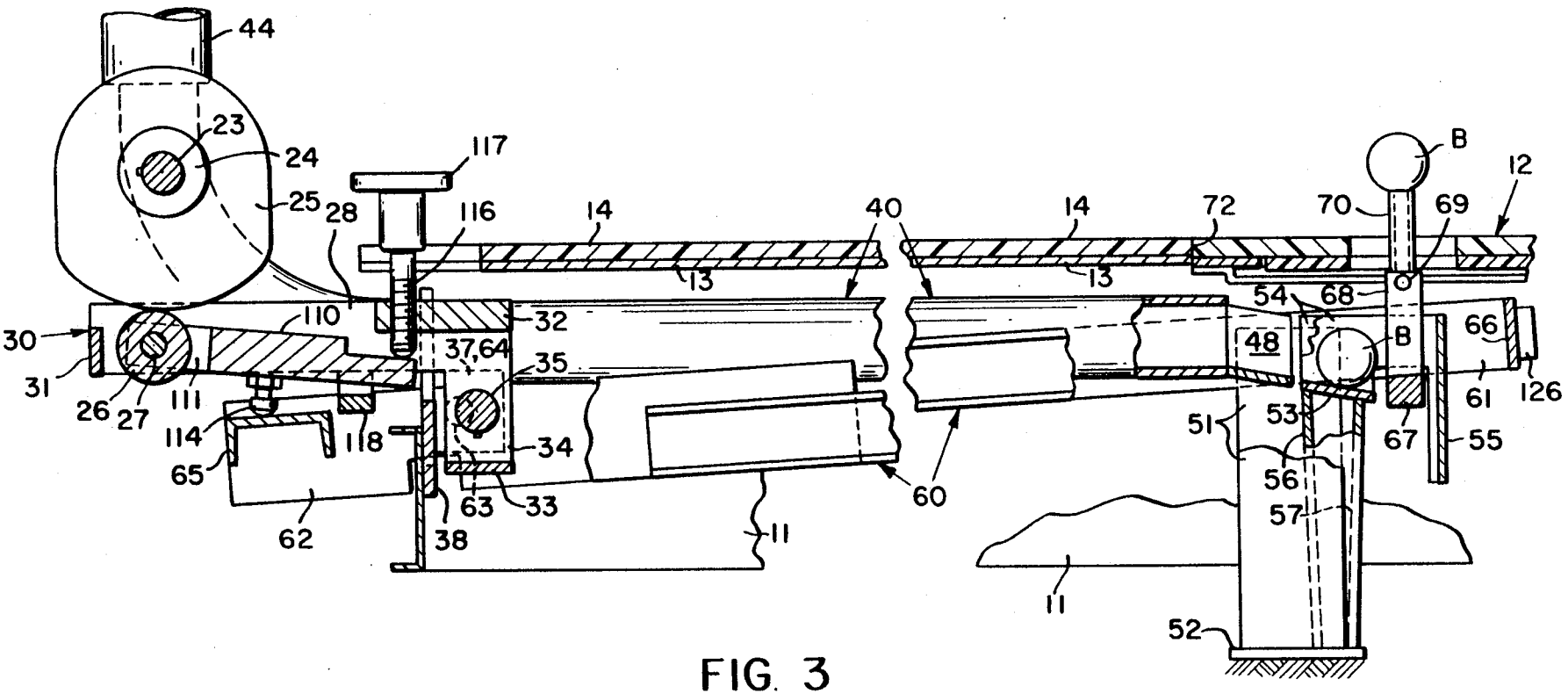
FIG. 3 is a greatly enlarged, fragmentary sectional view taken generally along the line 3—3 in FIG. 2 looking in the direction of the arrows, and showing the tee in its elevated position.
Figure 4:
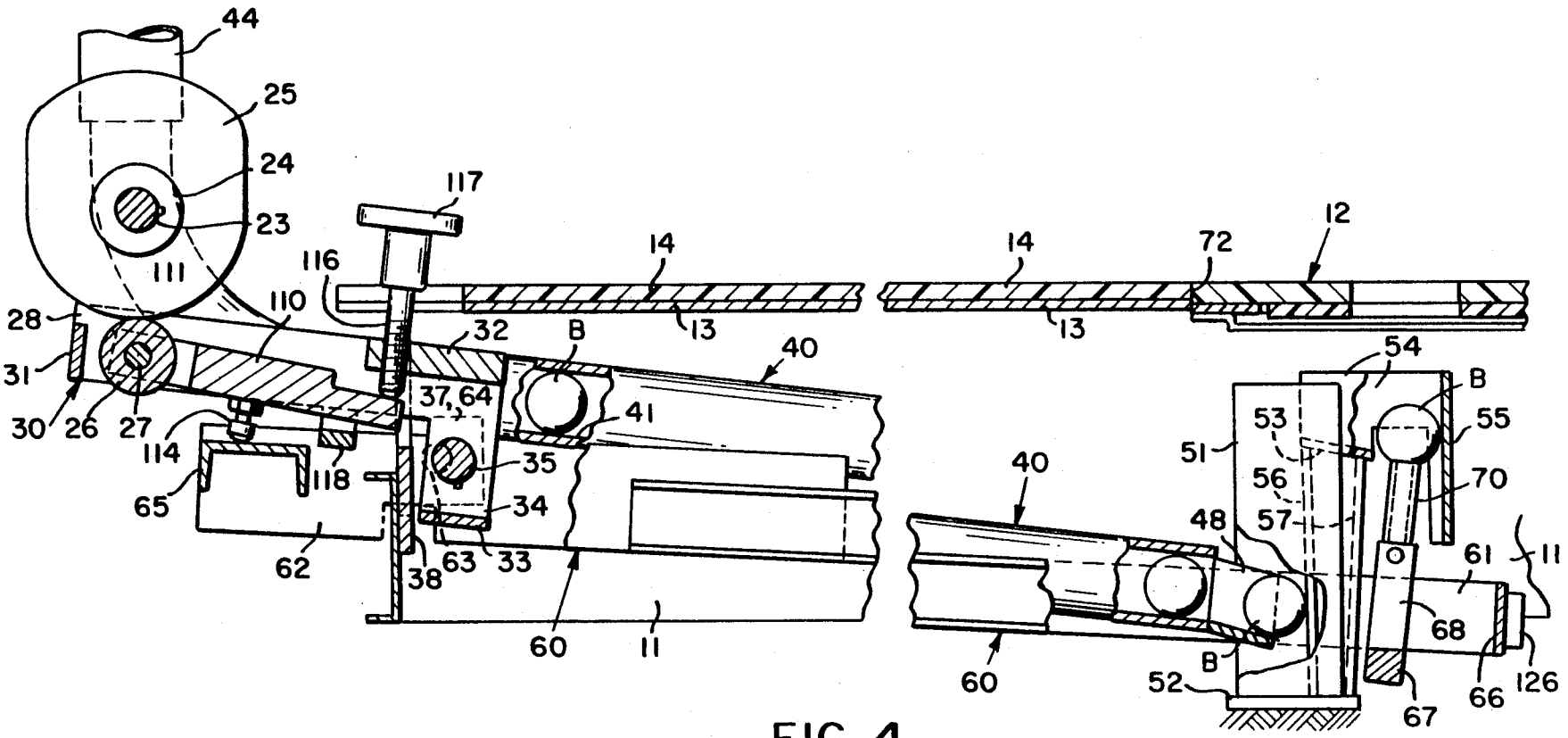
FIG. 4 is a view generally similar to FIG. 3, but showing the tee in its lowered position.
Figure 5:
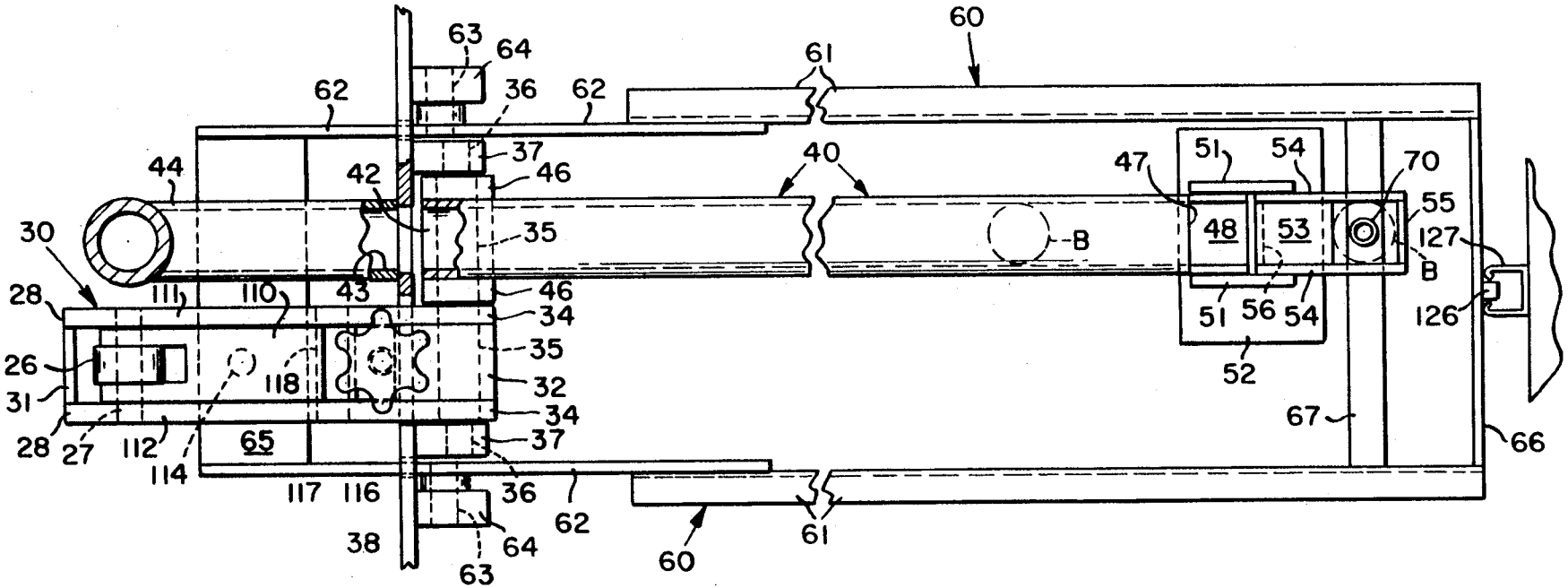
FIG. 5 is a fragmentary plan view of that portion of the apparatus shown in FIGS. 3 and 4, but with the covering floor section removed.

As shown more clearly in FIG. 5, adjacent its end remote from lever 30 the shaft 35 passes beneath one end of a pivotal golf ball supply chute 40, which has therethrough an axial bore 41 (FIG. 4). Bore 41 communicates at one end thereof (the left end in FIGS. 3-5) through a registering opening in the frame member 38 with the discharge end 43 of a stationary golf ball supply tube or chute 44, which feeds a golf ball B by gravity into chute 40 each time it pivots into its lower position as shown in FIG. 4. Tube 44 has its discharge end 43 secured to frame member 38 around the opening that communicates with chute 40; and at its opposite end tube 44 curves upwardly as illustrated in FIGS. 3 and 4 and is connected (by means not illustrated) to the interior of the ball hopper 15 to receive and deliver golf balls in single file to the inlet 42 of the pivotal supply chute 40. At opposite sides of its inlet end 42 the chute 40 is secured, as shown in FIG. 5, to the upper ends of a pair of spaced mounting plates 46, the lower ends of which are secured to the pivot pin or shaft 35, whereby chute 40 is supported by plates 46 for pivotal movement with the cam lever 30 about the axis of shaft 35.

At its opposite or discharge end 47 (FIG. 5), the chute 40 is disposed to be swung about the axis of shaft 35 as noted in greater detail hereinafter between an elevated position as shown in FIG. 3, and a lowered position as shown in FIG. 4. During this movement a generally U-shaped lip or projection 48, which is integral with and extends slightly beyond the discharge end 47 of the chute 40, is swung between a pair of spaced, parallel upstanding guide plates 51, which are secured to and extend upwardly from a stationary mounting plate 52 that is secured on the frame in any conventional manner. When chute 40 is in its upper position (FIG. 3), the bottom of its lip 48, which is inclined slightly downwardly relative to the bottom of chute 40, registers with a ball receiving platform 53 that extends transversely between a pair of spaced guide plates 54 that are secured to and extend forwardly from the upright plates 51. At their outer or right hand ends as shown in FIG. 5, plates 54 are interconnected by a transversely extending guide plate 55 the purpose of which will be described hereinafter. Two other spaced, generally vertically disposed guide plates 56 and 57 (FIGS. 3 and 4) extend between the support plate 52 and the bottom of the ball receiving platform 53.

Mounted for pivotal movement about an axis parallel to the axis of the shaft 35 is a pivotal tee supporting arm 60. Arm 60 comprises two, parallel, rather widely spaced angle irons 61 (FIG. 5) which have fastened to an projecting rearwardly from the inner ends thereof a pair of spaced, parallel, rigid support bars 62. Bars 62 are mounted intermediate their ends to pivot, respectively, about the inner ends of a pair of coaxial pivot pins 63, the outer ends of which are secured in a pair of bearing blocks 64 that are secured to the frame member 38 outwardly of the support arms 62. The support arms 62 extend rearwardly or to the left of the frame member 38 as shown in FIG. 5, and are secured at their inner surfaces to opposite ends of a transversely extending beam 65, which is operatively connected to cam 25 by means which are described in greater detail hereafter.

At the opposite end of arm 60 the outer or right hand ends of the angle irons 61, as shown in FIG. 5, are interconnected by a rigid, transversely extending strap member 66. Connected at opposite ends to the spaced arm members 61, and extending transversely therebetween is an elongate tee-supporting bar 67. Secured at its lower end to the upper surface of bar 67, and projecting upwardly therefrom into the space between guide plates 54, and just rearwardly of the inside surface of the guide plate 55, is a cylindrical, tee-supporting post 68. Removably secured at its lower end in a recess in the upper end of post 68 by a pin 69 is a cylindrically shaped tee 70. As shown more clearly in FIGS. 3 and 4, tee 70 is disposed releasably to support on its upper end a conventional golf ball B, which, as noted in greater detail hereinafter, is loaded automatically onto the upper end of the tee 70 when the arm 60 is pivoted to its lower position as shown in FIG. 4, and thereafter is raised by the tee 70 through a registering opening in the hitting area 12 to the position as shown in FIG. 3, wherein it is ready to be struck by a golfer's club.

Figure 6:
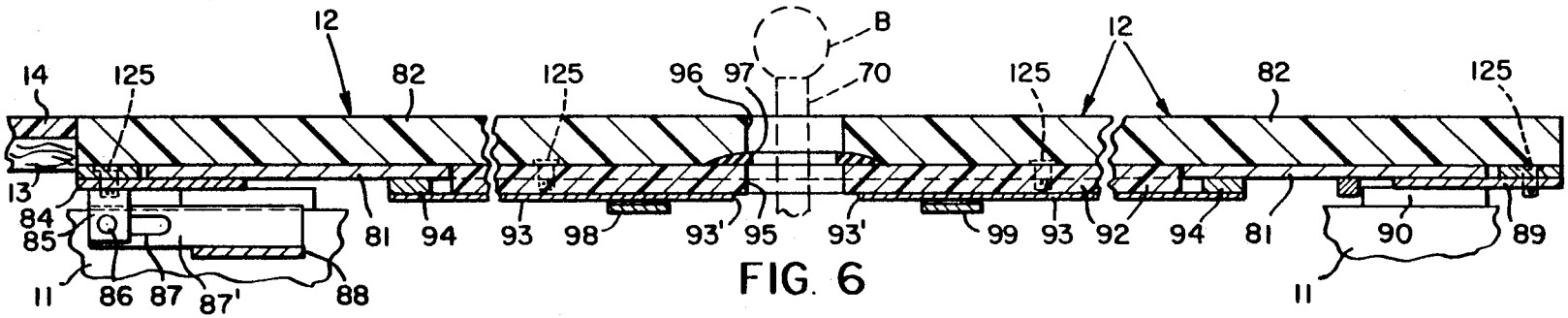
FIG. 6 is an enlarged, fragmentary sectional view taken generally along the line 6—6 in FIG. 2 looking in the direction of the arrows.
Figure 7:
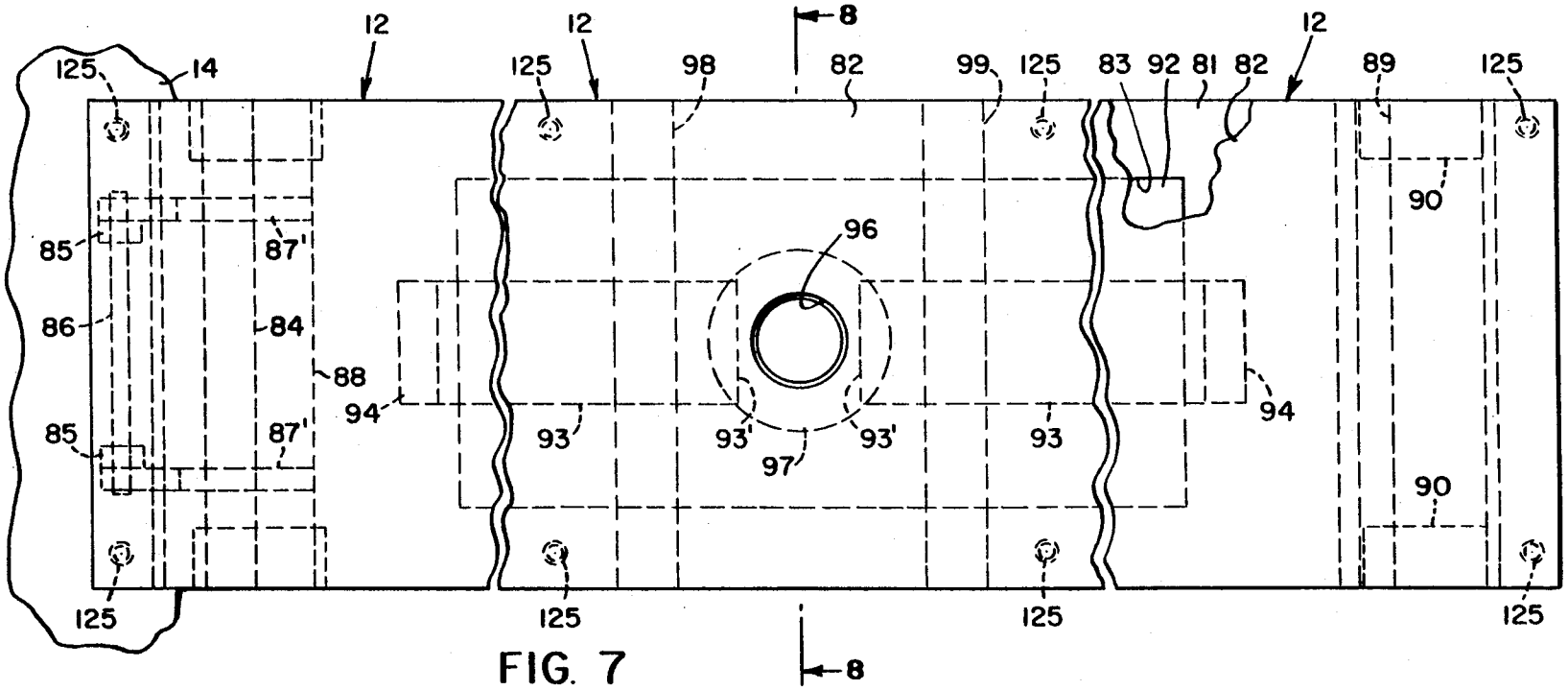
FIG. 7 is a fragmentary plan view of that portion of the apparatus shown in FIG. 6.
Figure 8:
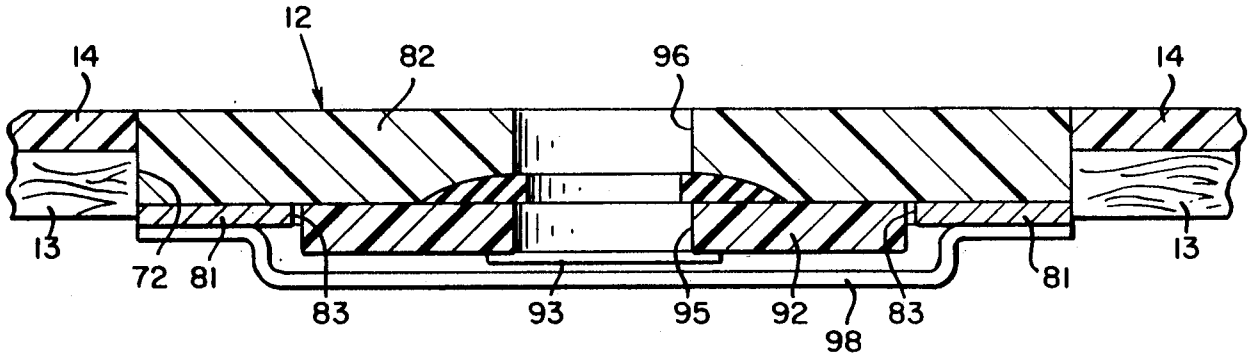
FIG. 8 is a slightly enlarged sectional view taken generally along the line 8—8 in FIG. 7 looking in the direction of the arrows.

Referring now to FIGS. 6 to 8, the turf coated plywood cover 13 has therein approximately medially of the sides of platform 10 a large rectangular opening 72, which extends inwardly from the forward or bottom edge of the platform 10 as shown in FIG. 2. Section 12 comprises a rectangularly shaped, flexible metal backing plate 81, which is covered by a knitted, synthetic turf layer 82. Plate 81 has in the center thereof beneath layer 82 an elongate, rectangular opening 83, the purpose of which will be noted hereinafter. Secured to and projecting downwardly from the underside of a spacer plate 84, which is fastened to the underside of the backing plate 81 adjacent the inner end thereof, are two, spaced, coaxially disposed bearings 85, which have therein registering axial bores in which is secured a hinge pin 86. Pin 86 projects at opposite ends thereof beyond the bearings 85, and slidably into elongate slots 87 formed in the outer ends of two, laterally spaced shaft supports 87' which are fastened at their inner ends to a stationary support block or strap 88 that forms part of the frame 11.

Secured to the underside of plate 81 adjacent its end remote from the hinge pin 86 is another reinforcing plate or strap 89, which, when the hitting section 12 is in its closed position as shown in FIG. 6, seats upon another stationary block or strap 90 that is secured to the frame 11 to extend transversely beneath the forward or right end of section 12 as shown in FIGS. 6 and 7.

For the purpose of duplicating as near as possible the feel and resilience of a conventional fairway or golf tee, a rather thick, rectangular foam pad 92 is supported in the rectangular opening 83 in the backing plate 81 by means of a pair of flexible spring straps 93, each of which is slightly narrower than pad 92. Each strap 93 is fastened at its outer end by a spacer member 94 to the underside of the backing plate 81 adjacent one end of the opening 83, and as shown more clearly in FIGS. 6 and 7, projects in a cantilevered fashion longitudinally inwardly of the opening 83 and centrally beneath the bottom of the foam layer 92. The free, inner ends 93' of the straps 93 terminate adjacent diametrially opposite sides, respectively, of registering, circular openings 95 and 96 that are formed in the centers of the pad 92 and the knitted hitting surface 82.

To provide added strength to the hitting surface 82 at the center thereof, a urethane grommet 97 is secured between the foam backing layer 92 and the overlying hitting surface 82 coaxially of the openings 95 and 96. Moreover, to limit the downward movement of the free ends of the spring support straps 93, as for example when the hitting surface 82 is struck by the head of a golf club, a pair of shallow, generally U-shaped support straps 98 and 99 are secured at opposite ends thereof to the plate 81 adjacent opposite sides of the opening 83, and extend transversely beneath the straps 93, and in slightly spaced relation thereto.

Figure 9:
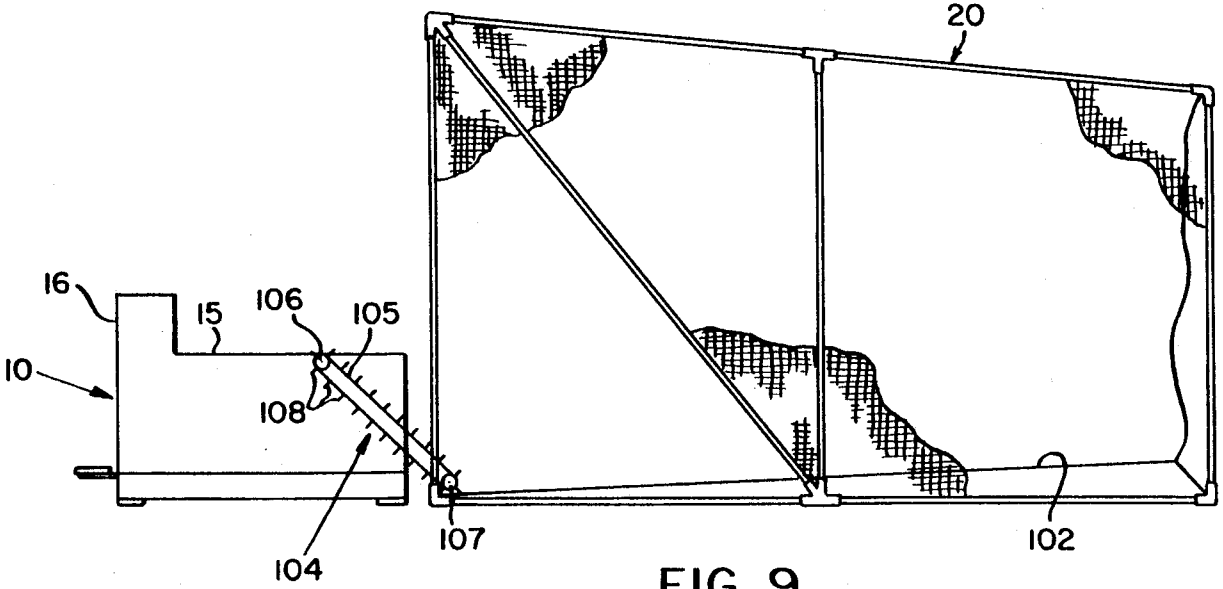
FIG. 9 is a fragmentary side elevational view illustrating diagramatically how the cage can be employed in connection with golf ball return apparatus.

Referring now to FIG. 9, the cage 20, which can be made collapsible in any conventional manner, is disposed to have a bottom wall 102 which is inclined from the outer end of the cage downwardly toward the inner or open end of the cage, and toward the lower end of a golf ball 104. Conveyor 104 comprises an endless chain or belt 105 that is mounted adjacent opposite ends thereof to travel about spaced, parallel sprocket wheels 106 and 107, or the like, which are mounted to rotate about spaced, parallel axes that extend transversely of the ball hopper 15. As shown in FIG. 9, the belt 105 has thereon a plurality of spaced, outwardly projecting, golf-ball engaging clips or pins 108, which are caused by the belt 105 to travel in an endless path adjacent the lower end of the ball return wall 102, and in such manner that the projections 108 engage and transport golf balls diagonally upwardly into the hopper 15 toward the sprocket wheel 106. As the conveyor belt 105 passes around wheel 106 the golf balls carried thereby are dropped into the hopper 15 for subsequent delivery to the stationary ball supply chute 44 (FIGS. 3 to 5).

Referring again to FIGS. 3 to 5, it is to be noted that although the cam 25 functions simultaneously to swing the interconnected arm 30 and chute 40 about the axis of shaft 35, there is still another, relatively short pivot arm 110 which is notched or furcated at one end thereof (the left end in FIGS. 3 to 5) so as to form thereon two spaced, parallel projections 111 and 112, which flank opposite sides of the cam follower 26, and which are pivotally connected to the pivot pin or shaft 27. Projecting from the underside of arm 110 approximately centrally thereof is an adjustable beam engaging pin or screw 114, the lower end of which engages the top of the beam 65. Thus, each time that the cam 25 causes the cam lever arm 30 and the attached supply chute 40 to be pivoted counterclockwise about the axis of shaft 35 from the positions shown in FIG. 4 to the positions shown in FIG. 3, the pin 114 likewise causes the beam 65, and hence the attached tee supporting arm 60 also to be pivoted counterclockwise about the axis of the pins 63, thereby causing the tee 70 to be swung from its lower position as shown in FIG. 4 to its upper position as shown in FIG. 3. Conversely, when the cam 25 is rotated 180° from its position as shown in FIG. 3, the weight of the chute 40 and arm 60 causes these members to be pivoted clockwise about their respective pivotal axes downwardly from the positions shown in FIG. 3 to their lowered positions as shown in FIG. 4.

It is desirable that the golfer have the ability to adjust the height of the tee 70 when the latter is in its upper or operative position as shown in FIG. 3. For this purpose an externally threaded, tee-adjusting screw 116 (FIGS. 3 to 5) is threaded intermediate its ends in an opening in the cross bar 32, which is integral with and extends between the arms 28 of the cam lever 30 adjacent its forward end. As shown more clearly in FIGS. 3 and 4, the lower end of screw 116 projects beneath the cross bar 32 and engages the forward end of the pivotal lever 110, while the opposite or upper end of screw 116 projects slidably upwardly through registering openings in the overlying panel 13 and turf layer 14, and has secured to its upper end above the turf layer 14 a knurled or notched handle 117, which permits the screw 116 to be rotatably adjusted by a golfer standing on the platform 10.

To effect tee adjustment, screw 116 can be threaded downwardly relative to bar 32 in order to urge the forward end of the lever 110 slightly downwardly or clockwise about the axis of pivot pin or shaft 27, thereby causing pin 114 to urge beam 65, and hence arm 60 slightly counterclockwise about the axis of the supporting pins 63, and relative to the ball feed chute 40. This will cause the tee 70, and hence the ball B thereon, to be elevated slightly relative to the plane upper surface of the hitting surface 12. Conversely, when the screw 116 is rotated in the opposite direction, its lower end is withdrawn upwardly relative to the supporting bar 32, and consequently lever 110 is permitted to rotate slightly counterclockwise relative to shaft 27, and in so doing elevates pin 114 slightly relative to beam 65, which therefore is permitted to pivot slightly clockwise about the axis of pins 63, thus lowering slightly the tee 70 relative to the hitting surface 12. These adjustments permit the tee 70 to be adjusted slightly vertically relative to the pivotal movement which normally is imparted to the tee supporting arm 60 by virtue of the engagement of cam 25 with the follower 26. However, to limit the pivotal adjustment of arm 110 counterclockwise about the axis of shaft 27, a metal strap 118 (FIGS. 3 and 4) is secured at opposite ends to arms 28 of the cam lever 30, and extends intermediate its ends beneath the pivotal adjusting lever 110 to limit the extent to which it can be pivoted clockwise about shaft 27 by the adjusting screw 116.

In use, the control pedestal or console 16 is designed to house either a non-vendoring control system, which can be actuated by a manually operated push button switch on the console, or alternatively, for vendor actuated systems, the control system can be designed to be activated using tokens, paper currency, key cards, bar code systems, etc. In either such system, once it is actuated, it can be based upon repeated operation for a predetermined period of time, or alternatively, can be controlled by the number of balls which will be automatically teed up for the golfer. When first activated, the system will operate motor 21 to lower the chute 40 about the axis of shaft 35 and arm 60 about the axis of pivot pins 63, downwardly from the upper positions as shown in FIG. 3 to the lowered positions as shown in FIG. 4. During this movement, and assuming that a ball B has already been placed upon the receiving platform 53, as the chute 40 drops downwardly, the plate 56 will prevent any further golf balls from being discharged from the outlet end of the chute 40. Also during this movement, as the tee 70 drops to its lowered position, the ball then on the receiving platform 53 will roll downwardly onto the upper end of the tee 70, as shown in FIG. 4. The plates 54 and 55 will keep the ball B centered on the tee 70 as the arm 60 is subsequently swung to its upper or operative position as shown in FIG. 3. Also, when the chute 40 returns to this upper position, another golf ball will roll onto the receiving platform 53 in position to be received by the tee 70 when the latter once again drops to its lowered position.

These movements are controlled by the cam 25, which in turn is controlled by the gear motor 21 in response to instructions received from the console 16. The instruction to operate the gear motor 21, however, is controlled directly by the golfer. For this purpose a mass sensor switch 120 (FIG. 2) is mounted under the surface of the platform 10 adjacent the front of the hitting area 12. In practice the location of the sensor 120 is marked on the hitting surface 82 by a round dot, or the like, so that when the club head is placed over the sensor 120 a signal is sent to the control console, and the motor 21 is automatically and intermittently operated in order to pivot the tee 70 downwardly and then upwardly to present a new golf ball B in a hitting position above surface 12. As noted above, the height of the tee 70 can then be adjusted by the golfer, as desired, by rotation of the handle 117, either to lower the tee 70 slightly to replicate a fairway shot, or if desired, to elevate the tee slightly to replicate a tee shot.

When the hitting surface becomes worn it can be replaced by swinging 12 upwardly about the axis of the hinge pin 86 (FIGS. 6 and 7). When this has been done the bottom of the hitting surface 12 is exposed, thus exposing also the inner, shank ends of a series of button head bolts 125, which are utilized for releasably securing the knitted turf hitting surface 82 to the flexible backing plate 81 of the hitting area 12. The bolts 125 have removable clevis pins, or the like, extending through the inner ends of their shanks, so that by removing the pins the bolts 125 can be disengaged from plate 81, thereby to permit removal and replacement of the hitting surface 82, and/or, to replace the foam layer 92, which is supported in the opening 83 in the backing layer 81. In the embodiment illustrated in FIG. 7 four such bolts 125 are located along each side of the hitting surface 12, but it will be understood by one skilled in the art that the type and number of bolts that are utilized for removably securing the knitting layer 82 onto the backing plate 81 can be varied as desired. In addition to the hitting area 12, the remainder of the horizontal cover on frame 11 may comprise on or more turf coated section 13 of plywood which can be removed and be recovered or replaced when necessary.

From the foregoing it will be apparent that the present invention provides an excellent training tool to improve a golfer's game. The practice platform 10 can be utilized by golfers to practice both wood and iron shots, the time between successive such shots being controlled by the golfer, who can cause successive golf balls to be teed up in an operating position on platform 10 simply by touching the mass sensor switch 120 with the head of his or her club. The apparatus is efficiently operated by a single gearmotor drive 21, with balls being automatically returned to the hopper 15 (See FIG. 9), when the cage 20 is utilized in combination with the ball return conveyor 104. After the tee pad section of the hitting area 12 has been unduly worn, the knitted turf layer 82 can be readily replaced, simply by swinging the hitting section 12 upwardly into an open position about its hinge pin 86. At such time the pad 92 can also be replaced, if desired; and, if necessary, the tee 70, which becomes accessible upon the opening of section 12 can also be replaced, if necessary.

One of the advantages of utilizing the special hitting area 12 is the fact that the cantilevered spring plates or straps 93 resiliently support the pad 92 beneath the overlying turf layer 82, thus providing a hitting surface which nearly duplicates the feel and performance of a natural tee or fairway surface.

Still another advantage of this apparatus is that the golfer can adjust the hitting height of the tee 70 simply by manipulating the handle 117, which controls the rotation of the adjusting screw 116. Moreover, by mounting the pivotal chute feeder 40 for movement with and adjacent to the tee supporting arm 60, these members are compactly and efficiently located beneath the upper surface of platform 10, thus minimizing the height that platform 10 will have to be positioned above the ground surface. Also, to stabilize the pivotal movement o the tee supporting arm 60, it is provided at its forward end (its right end in FIGS. 3 to 5), with a nose-shaped projection 126, which is adapted to be guided between the arms of a generally U-shaped bracket 127 (FIG. 5) that is fastened in a stationary position to the frame 11 in confronting relation to the guide projection 126.

While in the illustrated embodiment the pivotal ball chute has been shown to be tubular in configuration, it is to be understood that in practice it may be constructed differently, such as for example from a plurality of elongate rods secured in spaced, parallel relation to form in cross section a circular or rectangular array defining a chute through which golf balls can roll in tangential engagement with the rods.

Furthermore, while this invention has been illustrated and described in detail in connection with only certain embodiments thereof, it will be apparent that it is capable of still further modification, and that this application is intended to cover any such modifications as may fall within the scope of one skilled in the art, or the appended claims.

I claim:

1. Golf teeing and practice apparatus, comprising a platform having a golf ball delivery opening therein, a frame for supporting said platform horizontally, and having thereon beneath said platform a stationary golf ball support, a tee supporting arm mounted intermediate its ends on said frame beneath said platform for pivotal movement about a first axis, a golf ball feed chute mounted intermediate its ends on said frame beneath said platform for pivotal movement about a second axis, drive means for pivoting said arm and said chute between first and second limit positions about said axes, said chute having an inlet in one end thereof disposed to receive a golf ball from a supply thereof, when said chute is in one of its limit positions, and an outlet in the opposite end thereof disposed to deliver a golf ball to said stationary support, when said chute is in the other of its limit positions, and a tee mounted on said arm adjacent one end thereof for movement thereby between a receiving position in which a golf ball is delivered from said support onto the upper end of said tee, when said arm is in one of its limit positions, and a teeing position in which said upper end of said tee projects upwardly through said opening in said platform, when said arm is in the other of its limit positions.

2. Apparatus as defined in claim 1, wherein said drive means includes means for intermittently moving said chute and said arm in a cycle in which said arm and said chute pivot from said other to said one positions thereof, and then back to said other positions thereof.

3. Apparatus as defined in claim 1, including means for blocking said outlet of said chute when said chute is moved out of said other limit position thereof.

4. Apparatus as defined in claim 1, wherein said drive means comprises camming means operable intermittently, and cam follower mean interconnecting said tee supporting arm and said feed chute, and responsive to the operation of said camming means to pivot said arm and said chute in unison about said axes.

5. Apparatus as defined in claim 4, wherein said axes are disposed horizontally and in spaced, parallel relation, and said arm and said chute are pivotal by gravity about said axes from said other to said one limit positions.

6. Apparatus as defined in claim 4, wherein said cam follower means includes adjustable means interposed between said arm and said chute and operable manually to adjust the distance said one end of said arm is pivoted between said one and said other limit positions, thereby to adjust the extent to which said tee projects above said platform when said tee is in its teeing position.

7. Apparatus as defined in claim 4, wherein said cam follower means comprises a first lever fixedly connected to said chute and responsive to the operation of said camming means to pivot with said chute about said second axis, and adjustable means connecting said first lever to said tee supporting arm to impart said pivotal movement thereto about said first axis upon operation of said camming means, said adjustable means including a tee adjusting member projecting at one end beneath said platform, and at its opposite end upwardly through a second opening in said platform thereby to be manually adjustable from above said platform selectively to increase or decrease the pivotal movement imparted by said first lever to said arm, and thereby to adjust the extent to which the upper end of said tee extends above said platform when said arm is in said other limit position thereof.

8. Apparatus as defined in claim 7, wherein said tee adjusting member is adjustably threaded intermediate its ends in said first lever, a second lever is pivotally connected adjacent one end thereof to said first lever for pivotal movement about a third axis parallel to said first and second axes, and projects at its opposite end beneath said one end of said adjusting member, and said second lever is operatively connected intermediate its ends to said tee supporting arm, thereby to impart the pivotal movement of said first lever to said arm, and operable in response to the adjustment of said member to pivot said arm relative to said first lever.

9. Apparatus as defined in claim 1, wherein said platform comprises a generally rigid substrate covered with a layer of synthetic material, and disposed to support at least one practice golfer thereon, a resilient pad is removably mounted in an opening in said substrate and has said golf ball delivery opening extending therethrough, and resilient spring means is mounted on the underside of said platform and extends beneath said resilient pad adjacent said golf ball delivery opening resiliently to support said pad in said opening in said substrate.

10. Apparatus as defined in claim 9, wherein a flexible plate is hingedly connected along one edge thereof to said substrate for pivotal movement between a closed position over said opening in said substrate, and an open position in which said plate is inclined upwardly relative to said platform thereby to expose the underside of said plate, said pad is positioned removably in a central opening in said plate, a section of said synthetic material is removably secured to said plate over said pad and has therein a golf ball delivery opening registering with said delivery opening in said pad, and said spring means comprises a plurality of leaf spring elements each secured at one end to said plate and extending at its opposite end in cantilever fashion beneath said pad.

11. Apparatus as defined in claim 10, including a plurality of spaced pin means releasably securing said section of said synthetic material to said plate over said pad, and at least certain of said pin means being removable when said plate is in its open position, thereby to permit said pad to be removed and replaced through the side of said opening in said substrate remote from said leaf spring elements.

12. Golf teeing and practice apparatus, comprising a frame having on the upper end thereof a generally horizontal platform disposed to support at least one practice golfer thereon, a hopper extending along one side of said platform and disposed to hold a supply of golf balls, a resilient pad removably mounted in an opening in said platform in laterally spaced relation to said hopper, and having therethrough a golf ball delivery opening, resilient spring means secured to the underside of said platform and extending beneath said pad adjacent said delivery opening, thereby to support said pad resiliently and removably in said opening in said platform, a layer of flexible material removably secured over said pad to retain the said pad removably in said opening in said platform and having therethrough a golf ball delivery opening registering with said delivery opening in said pad, a cylindrical tee disposed to support a golf ball on the upper end thereof, means supporting said tee on said frame for movement between a first limit position beneath said platform, and a second limit position in which said tee extends upwardly through said delivery openings in said flexible material and said pad to place said upper end of the tee at a predetermined height relative to said layer of flexible material, and feeding means communicating with the interior of said hopper to receive a golf ball therefrom each time said tee is moved to one of its two limit positions, said feeding means including positioning means operative each time said tee is in its first limit position to place a golf ball onto said upper end of said tee for movement thereby into a teed position when said tee is moved to its second limit position.

13. Apparatus as defined in claim 12, including an annular, reinforcing grommet secured between said pad and said layer of flexible material and surrounding said ball delivery opening in said flexible material coaxially thereof.

14. Apparatus as defined in claim 12, including a collapsible golf ball retaining cage mounted adjacent said frame and having an open end facing a second side of said platform in confronting relation to said hitting surface, thereby to collect golf balls driven from said platform by a practice golfer, said cage having a bottom wall inclined toward said hopper to cause captured golf balls to return by gravity from said cage to said hopper.

15. Apparatus as defined in claim 14, including means for conveying golf balls from said cage to said hopper.

16. Apparatus as defined in claim 12, wherein said means for supporting said tee for movement between its first and second limit positions includes tee adjusting means mounted on said frame beneath said platform and having a handle section projecting above said platform for manual operation by a practice golfer to adjust said predetermined height of the upper end of said tee relative to said layer of flexible material.

17. Apparatus as defined in claim 12, wherein a drive motor is mounted on said frame and is disposed to be operated intermittently, means connects said motor to said tee supporting means and is operative in response to the operation of said motor to move said tee in a cycle from said second limit position thereof to said first limit position, and then back to said second limit position, and said feeding means comprises a feed chute having an inlet end and an outlet end, respectively, and mounted on said frame for movement also in a cycle by said motor from a first limit position in which a ball is transferred from said outlet end of the chute to said positioning means, to a second limit position in which said chute receives a ball at its inlet end from the supply thereof in said hopper, and then back to said first limit position thereof.

18. Apparatus as defined in claim 12, wherein the portion of said platform containing said layer of flexible material and said pad is hingedly connected along one edge thereof to the remaining portion of said platform, said remaining portion of said platform comprises a generally rigid substrate layer having a replaceable, synthetic layer secured thereover.

* * * * *